US005209288A

United States Patent [19]

Brown et al.

[11] Patent Number: 5,209,288

[45] Date of Patent: May 11, 1993

[54] INTERRUPTED MONOGROOVE SLOT

[75] Inventors: Richard F. Brown; Fred Edelstein, both of Hauppauge; Robert L. Kosson, Massapequa, all of N.Y.

[73] Assignee: Grumman Aerospace Corporation, Bethpage, N.Y.

[21] Appl. No.: 774,338

[22] Filed: Oct. 10, 1991

[51] Int. Cl.[5] ..... F28D 15/02

[52] U.S. Cl. ..... 165/104.26; 165/41

[58] Field of Search ..... 165/104.26, 41

[56] References Cited

U.S. PATENT DOCUMENTS

| | | | |
|---|---|---|---|
| 4,422,501 | 12/1983 | Franklin et al. | 165/104.26 |
| 4,470,451 | 9/1984 | Alario et al. | 165/104.26 |
| 4,515,207 | 5/1985 | Alario et al. | 165/1 |
| 4,520,865 | 6/1985 | Bizzell | 165/104.26 |
| 4,583,587 | 4/1986 | Alario et al. | 165/104.26 |
| 4,807,697 | 2/1989 | Gernert et al. | 165/104.26 |
| 4,917,173 | 4/1990 | Brown et al. | 165/13 |

*Primary Examiner*—Albert W. Davis, Jr.
*Attorney, Agent, or Firm*—Bacon & Thomas

[57] ABSTRACT

An interrupted monogroove slot in a heat pipe facilitates priming of the heat pipe under zero gravity conditions by preventing the monogroove slot from completely priming before the liquid channel is primed.

5 Claims, 2 Drawing Sheets

INTERRUPTED MONOGROOVE SLOT

ORIGIN OF THE INVENTION

The invention described herein was made in the performance of work under a NASA contract and is subject to the provisions of §305 of the National Aeronautics and Space Act of 1958, Public Law 85-568 (72 Stat. 435; 42 U.S.C. §2457).

BACKGROUND OF THE INVENTION

1. Field of the Invention

This invention relates to a heat pipe, and in particular to a heat pipe including a monogroove slot designed to facilitate priming of the heat pipe in zero gravity.

2. Description of Related Art

The monogroove heat pipe is a heat transport device which includes parallel liquid and vapor channels connected to each other by a slot which communicates with an extends the length of both the liquid and vapor channels. During normal operation, liquid under pressure fills the liquid channel, the slot, and fine circumferential grooves which line the vapor channel walls. At the hot end of the heat pipe, liquid in the circumferential grooves evaporates, causing a flow of vapor in the vapor channel towards the cold end of the pipe, where condensation occurs. Liquid returns to the evaporator through the liquid channel by capillary forces, completing the fluid circuit. This type of heat transport device has a number of advantages, including simplicity, relative efficiency, and rapid start-up or priming, making the monogroove heat pipe suitable for a wide variety of applications. One application to which the monogroove heat pipe appears to be especially suited is the proposed U.S. Space Station.

Nevertheless, the monogroove heat pipe is disadvantageous in that, as the heat pipe is primed under zero gravity conditions, capillary forces tend to cause the liquid to preferentially fill the smaller slot region before filling the larger liquid channel, trapping enough vapor in the liquid channel to impede heat pipe start-up. This phenomenon is illustrated in FIG. 1, which shows a monogroove heat pipe 1, including a vapor channel 2, a slot 3, and a liquid channel 4. Due to launch loads, the liquid in the heat pipe may be forced into the condenser end 5 of the pipe during launch. The pipe is primed after launch by liquid entering liquid channel 4 in the direction of arrow A.

In addition to the working fluid liquid and vapor, the heat pipe may contain a small amount of non-condensable gas (NCG) (on the order of 30 ppm) due to a low grade reaction of the working fluid with the walls of the heat pipe.

During priming, slot 3 is designed to permit the vapor-NCG mixture to escape into vapor channel 2 under normal conditions but, under the zero gravity conditions noted above, capillary forces tend to cause a portion 6 of the slot 3 to prematurely fill with liquid, preventing escape of some of the vapor-NCG mixture into the vapor channel. As a result, the bubble 7 remaining in liquid channel 4 forms a barrier which prevents the liquid from completely filling the channel. Inadequate priming of the heat pipe prevents proper feeding of liquid into the unprimed portion of the evaporator, reducing heat transfer in that region.

In order to overcome this problem, it has been proposed to increase the slot dimension to be equal to one-half of the liquid channel diameter, thus eliminating the capillary action which causes the slot 3 to fill first. However, this solution severely reduces the axial heat transport capability of the heat pipe, and thus is not an acceptable solution.

SUMMARY OF THE INVENTION

It is an objective of the invention to provide a monogroove heat pipe capable of being rapidly primed under zero gravity conditions.

It is a further objective of the invention to provide a monogroove heat pipe which includes parallel liquid and vapor channels connected by a slot, in which the slot is prevented from completely filling before priming of the liquid channel.

It is a still further objective of the invention to provide a monogroove heat pipe which includes parallel liquid and vapor channels connected by a slot, in which the size of a bubble trapped in the liquid channel during priming is minimized and the bubble is isolated in an unheated zone of the heat pipe.

It is yet another objective of the invention to provide a monogroove heat pipe including parallel liquid and vapor channels connected by a slot, in which premature failure of the heat pipe is prevented with no change in axial heat transport capability, and which is simple and inexpensive to fabricate.

These objectives are achieved by providing a monogroove heat pipe having parallel liquid and vapor channels connected by a slot in which a slot interrupter in the form of a barrier is provided at one end of the heat pipe, in a portion of the slot which is at least substantially outside of the heated zone in which the heat pipe operates.

Because the interrupted slot monogroove heat pipe is capable of reliably operating under zero gravity conditions, it is expected that the invention will find particular application in the proposed U.S. Space Station and other space applications, although it will be appreciated that the invention is not to be limited to any particular space application.

BRIEF DESCRIPTION OF THE DRAWINGS

FIG. 1(*b*) is a cross sectional side view of the monogroove heat pipe of FIG. 1(*a*), showing the manner in which capillary action in the monogroove slot prevents priming of a liquid channel of the heat pipe.

DETAILED DESCRIPTION OF THE PREFERRED EMBODIMENT

As described above, FIGS. 1(*a*) and 1(*b*) schematically show a conventional monogroove heat pipe of the type proposed for use in the U.S. Space Station. Before and during launch, the heat pipe is situated in the launch vehicle such that the condenser end 5 is located below the evaporator end of the heat pipe, and liquid is at the condenser end. The pipe contains a vapor channel 2, a monogroove slot 3, and a liquid channel 4. Slot 3 extends the length of the heat pipe and communicates with both the liquid and vapor channels everywhere along its length.

Figure 1A:
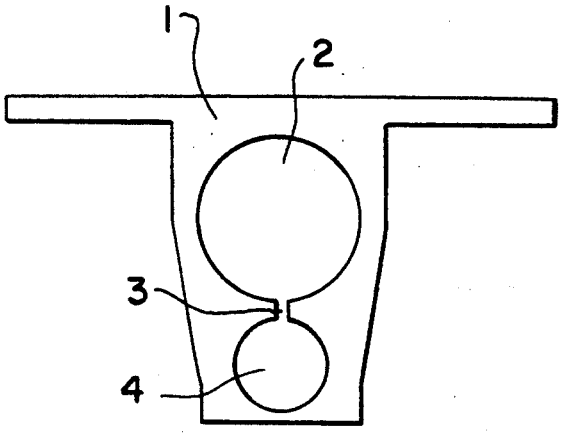
PRIOR ART FIG. 1a
FIG. 1(*a*) is an elevated end view of a monogroove heat pipe of the type presently used.
Figure 1B:
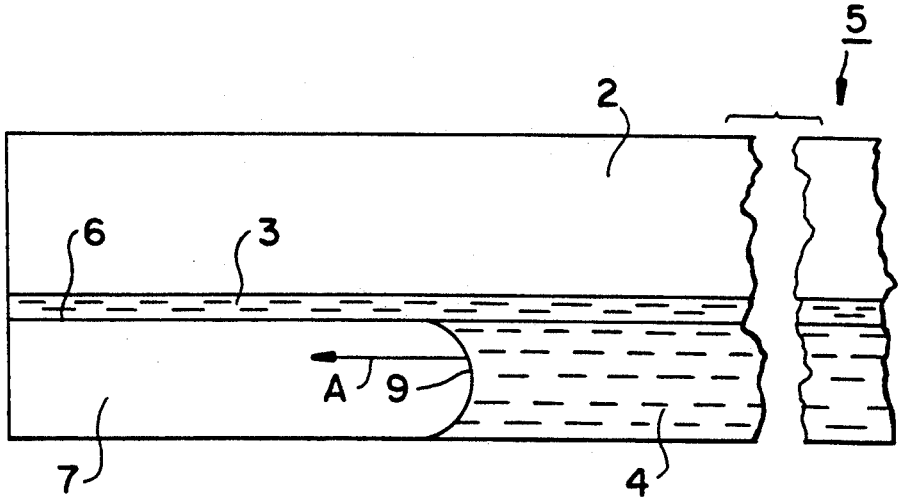
PRIOR ART FIG. 1b

In practice, the heat pipe of FIG. 1 would extend a distance of approximately 40–50 feet, although the length of the heat pipe is not essential to the invention. Despite the length of the heat pipe, priming occurs in a few seconds on earth, when the pipe is laid horizontally. On earth, due to gravity, the liquid channel fills in the direction of arrow A at substantially the same rate as the slot. However, in zero gravity, capillary action causes the slot to fill first, sealing a bubble 7 in the liquid channel and therefore preventing the liquid channel from completely filling.

Figure 2A:
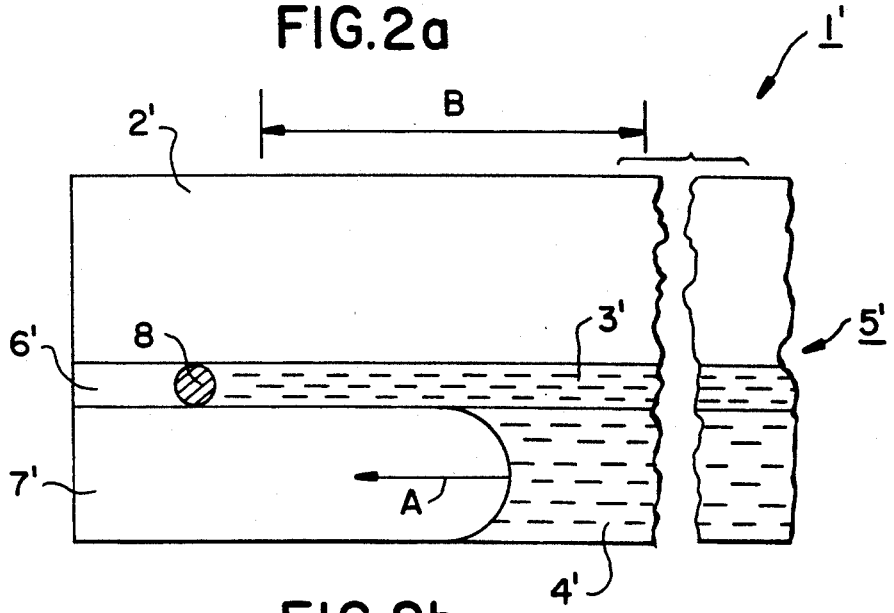
FIGS. 2(*a*)–(*c*) are cross sectional side views of a monogroove heat pipe constructed in accordance with the principles of a preferred embodiment of the invention, showing the manner in which the preferred monogroove heat pipe is primed.
Figure 2B:
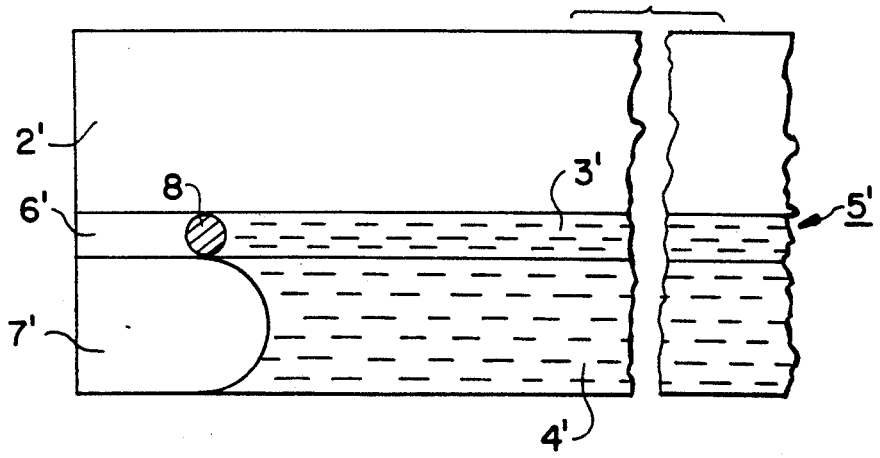
Figure 2C:
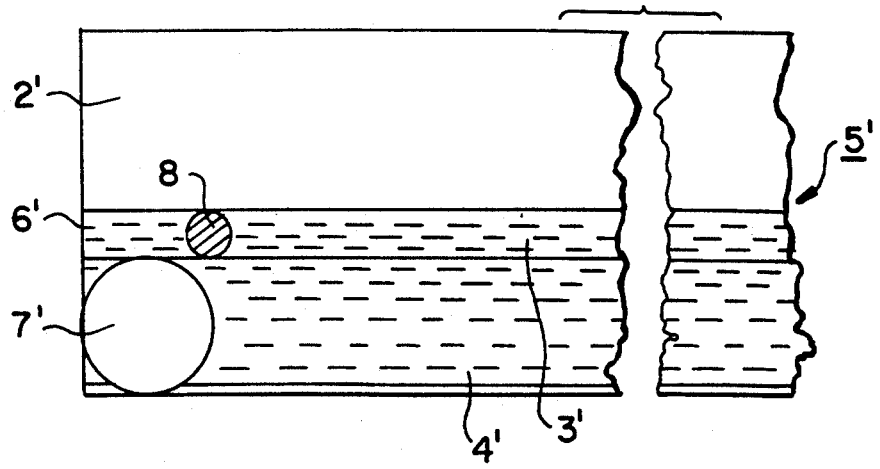

In order to overcome this problem, a slot interrupter 8 is provided in heat pipe 1', shown in FIG. 2, which is otherwise essentially identical to the heat pipe shown in FIG. 1. Slot interrupter 8 may take any form, so long as it completely or substantially completely fills a cross-sectional area of slot 3' to block liquid moving in the direction of arrow A from filling end 6' of the slot, thus leaving an escape route for vapor-gas bubble 7' to the vapor channel. For example, if the heat pipe is manufactured by casting, interrupter 8 may be cast as a wall connecting the lateral sides of the slot. Alternatively, interrupter 8 may take the form of a gasket-like plug retrofitted into the slot and subsequently fixed in place.

In operation, the vapor-gas mixture preceding the liquid filling channel 4' during priming escapes through portion 6' of the slot into vapor channel 2' until slot interrupter 8 is passed by the liquid, after which, capillary action takes over to fill portion 6'. By this time, however, the gas bubble has been reduced to an area to the left of slot interrupter 8, as shown in FIG. 2, which is outside the operative or heated zone of the pipe.

In order to disperse heat effectively, heat pipes are generally longer than their heated zone. Arrow B shown in FIG. 2(*a*) indicates the approximate extent of the heated zone. By placing slot interrupter 8 outside of the heated zone, bubble 7' as shown in FIG. 2(*c*) is prevented from impeding operation of the heat pipe after priming. Thus, the slot interrupter not only facilitates priming of the heat pipe, but also improves the operation of the heat pipe after priming.

It will of course be appreciated that the liquid used in the heat pipe need not be ammonia, and that other liquids of suitable thermodynamic and transport properties may be substituted. Slot interrupter 8 may of course be made of any material suitable for blocking slot 3', for example the same material as the heat pipe body. In addition, it will be appreciated that use of the heat pipe will find application in numerous zero gravity situations other than the Space Station, for example, other large spacecraft or for use on lunar and planetary missions. Consequently, it is intended that the invention not be limited to the specific context and structure described herein, but rather that it be limited solely by the appended claims.

We claim:

1. A heat pipe, comprising:

a liquid channel;

a vapor channel;

a slot in communication with both said liquid channel and said vapor channel;

slot interrupter means in said slot for preventing liquid from completely filling said slot during initial priming until liquid advancing into said liquid channel has passed said slot interrupter means.

2. A heat pipe as claimed in claim 1, wherein said slot interrupter is a barrier extending between lateral walls of said slot.

3. A heat pipe as claimed in claim 1, wherein said slot interrupter is located downstream of a heated zone of said heat pipe in a direction of initial priming.

4. A heat pipe as claimed in claim 1, wherein said slot interrupter means provides an escape passage from the liquid channel to the vapor channel for the vapor-gas mixture preceding said and advancing liquid during initial priming.

5. A method of priming a heat pipe of the type which includes a liquid channel, a vapor channel, and a slot in communication with both the liquid channel and the vapor channel, comprising the step of providing an obstruction in the slot in order to prevent the slot, during initial priming, from filling with liquid before the liquid channel is filled, thereby providing an escape route, located downstream of the obstruction, for the vapor-gas mixture preceding the liquid as the liquid channel is filled during priming.

* * * * *